US011092046B2

(12) United States Patent
Nakayama et al.

(10) Patent No.: US 11,092,046 B2
(45) Date of Patent: Aug. 17, 2021

(54) VALVE TIMING REGULATION DEVICE

(71) Applicant: MITSUBISHI ELECTRIC CORPORATION, Tokyo (JP)

(72) Inventors: Atsuyoshi Nakayama, Tokyo (JP); Masayuki Yokoyama, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 16/979,008

(22) PCT Filed: Mar. 30, 2018

(86) PCT No.: PCT/JP2018/013787
§ 371 (c)(1),
(2) Date: Sep. 8, 2020

(87) PCT Pub. No.: WO2019/187057
PCT Pub. Date: Oct. 3, 2019

(65) Prior Publication Data

US 2020/0408116 A1 Dec. 31, 2020

(51) Int. Cl.
*F01L 1/352* (2006.01)
*F01L 1/02* (2006.01)

(52) U.S. Cl.
CPC ..... *F01L 1/352* (2013.01); *F01L 1/022* (2013.01); *F01L 2250/02* (2013.01); *F01L 2820/032* (2013.01)

(58) Field of Classification Search
CPC F01L 1/352; F01L 2013/103; F01L 2820/032
USPC ..... 123/90.17, 90.27
See application file for complete search history.

(56) References Cited

U.S. PATENT DOCUMENTS

2008/0083388 A1* 4/2008 Uehama ..... F01L 1/352 123/90.17
2008/0210182 A1* 9/2008 Schaefer ..... F01L 1/352 123/90.17
2009/0199797 A1* 8/2009 Schafer ..... F01L 1/34 123/90.17
2015/0083061 A1* 3/2015 Muller ..... F01L 1/352 123/90.15

FOREIGN PATENT DOCUMENTS

JP 2011-80482 A 4/2011

* cited by examiner

*Primary Examiner* — Jorge L Leon, Jr.
(74) *Attorney, Agent, or Firm* — Birch, Stewart, Kolasch & Birch, LLP.

(57) ABSTRACT

A first rotator (6) includes an internal gear (14) and rotates in conjunction with a crankshaft (4). A second rotator (12) includes an output gear (121) and rotates in conjunction with a camshaft (3). A planetary rotator (13) includes a planetary gear (131) that meshes with the internal gear (14) and the output gear (121), and the planetary gear (131) meshes with the internal gear (14) and the output gear (121) to perform planetary motion, thereby changing the relative rotational position between the first rotator (6) and the second rotator (12). An input shaft (16) causes the planetary rotator (13) to perform planetary motion. A first bearing (18) is interposed between the input shaft (16) and the first rotator (6). A planetary bearing (17) is interposed between the input shaft (16) and the planetary rotator (13), and is included on the same plane orthogonal to the rotation axis (O) as the first bearing (18).

8 Claims, 5 Drawing Sheets

VALVE TIMING REGULATION DEVICE

TECHNICAL FIELD

The present invention relates to a valve timing regulation device for regulating the opening and closing timing of an intake valve or an exhaust valve of an engine.

BACKGROUND ART

A valve timing regulation device described in Patent Literature 1 has a structure in which a gear portion of a driving rotator that rotates in conjunction with a crankshaft meshes with one gear portion of a planetary rotator, and a gear portion of a driven rotator that rotates in conjunction with a camshaft meshes with another gear portion of the planetary rotator.

In the valve timing regulation device described in Patent Literature 1, a second moment that is generated in the planetary rotator by the radial load of the gear portion of the driving rotator is greater than a first moment generated in the planetary rotator by the radial load of the gear portion of the driven rotator, and thus the planetary rotator tends to rotate in the direction of the second moment and to tilt with respect to the normal axial direction. However, the inclination of the planetary rotator is suppressed by the reaction force applied from a support portion of a planetary carrier that contacts the planetary rotator to support the planetary rotator.

CITATION LIST

Patent Literature

Patent Literature 1: JP 2011-80482 A

SUMMARY OF INVENTION

Technical Problem

In the valve timing regulation device described in Patent Literature 1, assuming a bearing that rotatably supports the driving rotator and the planetary carrier, as the fulcrum, the planetary carrier has a cantilever structure. Therefore, when the planetary carrier tilts due to the moment acting with the bearing being the fulcrum, the planetary rotator also tilts. This resulted in a disadvantage that a thrust load is generated between the gear portions meshing with each other, thereby reducing the durability and the output of the valve timing regulation device.

The present invention has been made to solve the above described disadvantage, and an object of the present invention is to prevent a reduction in durability or output of a valve timing regulation device.

Solution to Problem

A valve timing regulation device according to the present invention includes: a first rotator to rotate in conjunction with a crankshaft, the first rotator including a first gear portion; a second rotator to rotate in conjunction with a camshaft, the second rotator including a second gear portion; a planetary rotator including a planetary gear portion that meshes with the first gear portion and the second gear portion, the planetary gear portion meshing with the first gear portion and the second gear portion to perform planetary motion, thereby changing a relative rotational position between the first rotator and the second rotator with the planetary gear portion meshing; an input shaft to cause the planetary rotator to perform planetary motion; a first bearing interposed between the input shaft and the first rotator; and a planetary bearing interposed between the input shaft and the planetary rotator, the planetary bearing included on the same plane orthogonal to a rotation axis as the first bearing.

Advantageous Effects of Invention

According to the present invention, the first bearing and the planetary bearing are included on the same plane orthogonal to the rotation axis, and thus the inclination of the planetary rotator with respect to the rotation axis is suppressed, thereby preventing a reduction in durability or output of the valve timing regulation device.

DESCRIPTION OF EMBODIMENTS

To describe the present invention further in detail, embodiments for carrying out the present invention will be described below with reference to the accompanying drawings.

First Embodiment

Figure 1:
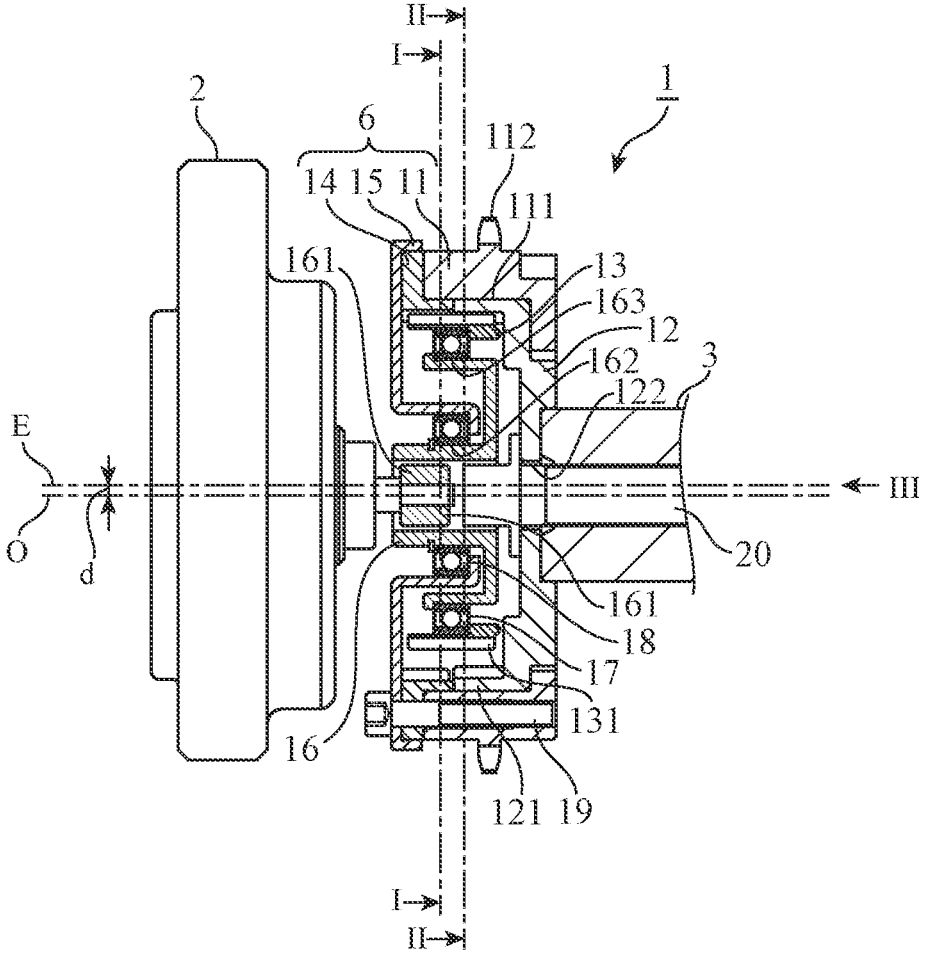
FIG. 1 is a cross-sectional view illustrating a configuration example of a valve timing regulation device according to a first embodiment.
Figure 2:
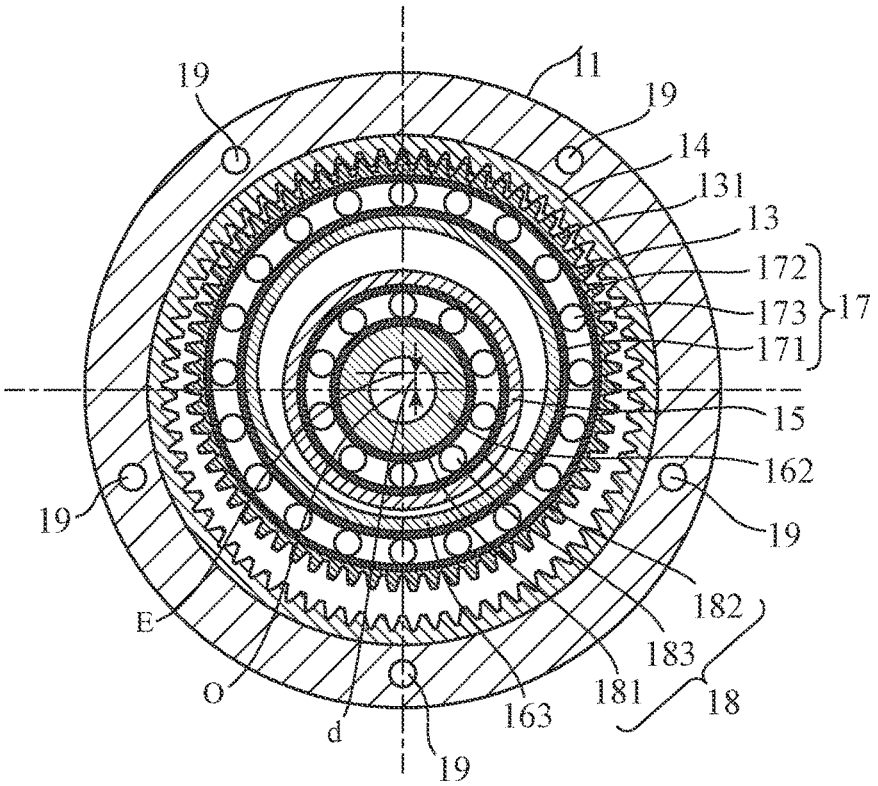
FIG. 2 is a cross-sectional view of the valve timing regulation device according to the first embodiment, taken along line I-I in FIG. 1.
Figure 3:
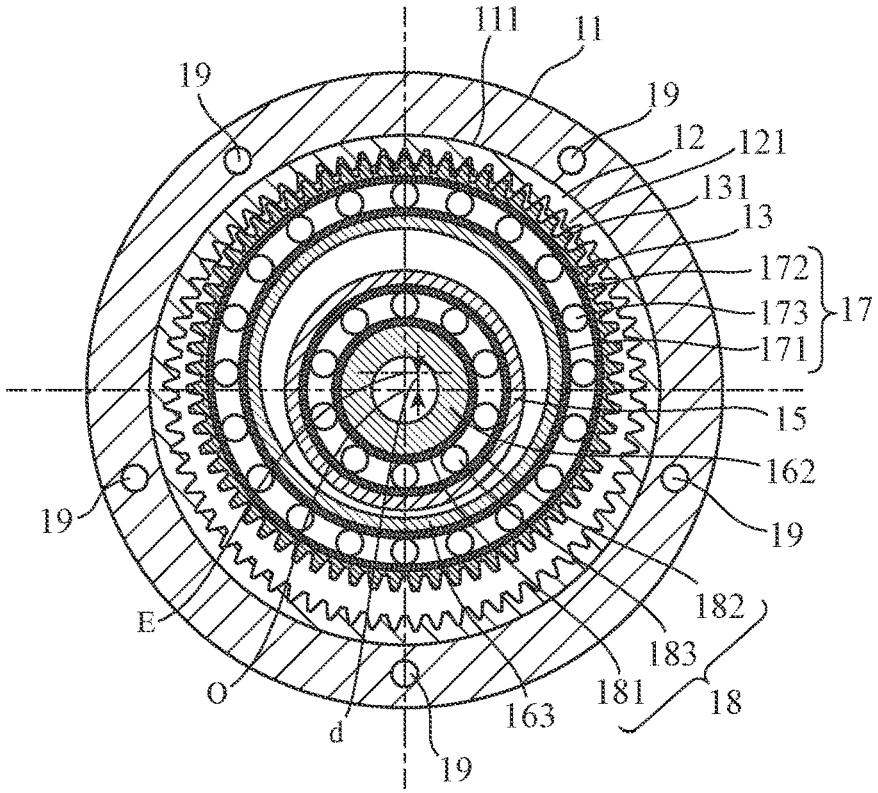
FIG. 3 is a cross-sectional view of the valve timing regulation device according to the first embodiment, taken along line II-II in FIG. 1.

FIG. 1 is a cross-sectional view illustrating a configuration example of a valve timing regulation device 1 according to a first embodiment. FIG. 2 is a cross-sectional view of the valve timing regulation device 1 according to the first embodiment, taken along line I-I in FIG. 1. FIG. 3 is a cross-sectional view of the valve timing regulation device 1 according to the first embodiment, taken along line II-II in FIG. 1. The valve timing regulation device 1 includes a first rotator 6, a second rotator 12, a planetary rotator 13, an input shaft 16, a planetary bearing 17, and a first bearing 18. The first rotator 6 includes a case 11, an internal gear 14, and a cover 15. The internal gear 14 corresponds to a first gear portion. The second rotator 12 includes an output gear 121 that corresponds to a second gear portion. The planetary rotator 13 includes a planetary gear 131 that corresponds to a planetary gear portion.

As illustrated in FIG. 1, an output shaft of a motor 2 and a camshaft 3 are arranged on the same rotation axis O and rotate on the rotation axis O. The input shaft 16 has a fitting portion 161 to which the output shaft of the motor 2 fits, and receives the torque of the motor 2 and thus rotates on the rotation axis O. The input shaft 16 includes a first bearing holder 162 that holds the first bearing 18 at a position centered at the rotation axis O, and a planetary bearing holder 163 for holding the planetary bearing 17 at a position centered at an eccentric axis E that is eccentric in the radial direction by an eccentric distance d with respect to the rotation axis O.

The planetary bearing 17 is interposed between the planetary bearing holder 163 and the planetary rotator 13, and causes the input shaft 16 and the planetary rotator 13 to rotate relatively. The planetary bearing 17 is, for example, a single-row rolling bearing including an inner ring 171, an outer ring 172, and a plurality of rolling elements 173. The inner ring 171 is fixed to the planetary bearing holder 163 of the input shaft 16, and the outer ring 172 is fixed to the planetary rotator 13.

The first bearing 18 is interposed between the first bearing holder 162 and the cover 15, and causes the input shaft 16 and the first rotator 6 to rotate relatively. The first bearing 18 is, for example, a single-row rolling bearing including an inner ring 181, an outer ring 182, and a plurality of rolling elements 183. The inner ring 181 is fixed to the first bearing holder 162 of the input shaft 16, and the outer ring 182 is fixed to the cover 15.

The internal gear 14 is press-fitted and fixed to one end surface of the case 11. The case 11, the internal gear 14, and the cover 15 are integrated by being fastened together by bolts 19 to form the first rotator 6. The internal gear 14 meshes with the planetary gear 131 of the planetary rotator 13 on the motor 2 side. The output gear 121 meshes with the planetary gear 131 of the planetary rotator 13 on the camshaft 3 side. That is, the internal gear 14 and the output gear 121 are aligned in the direction of the rotation axis O. The second rotator 12 in which the output gear 121 is formed is supported by a slide bearing 111 formed on the inner circumferential surface of the case 11, and rotates relatively to the case 11.

In the first embodiment, the output gear 121, the planetary gear 131, and the internal gear 14 function as a 2K-H type planetary gear mechanism. That is, the number of teeth and the addendum modification of the output gear 121, the planetary gear 131, and the internal gear 14 are adjusted so that on a plane orthogonal to the rotation axis O, the distance from the rotation center of the planetary gear 131 to the rotation center of the internal gear 14 is equal to the eccentric distance d and the distance from the rotation center of the planetary gear 131 to the rotation center of the output gear 121 also is equal to the eccentric distance d. Note that the speed reducer used in the valve timing regulation device 1 is not limited to the 2K-H type planetary gear mechanism, but may be a hypocycloid speed reducer or the like.

When the input shaft 16 rotates clockwise in the 2K-H type planetary gear mechanism, the planetary rotator 13 performs the planetary motion of revolving counterclockwise around the rotation axis O while rotating on the eccentric axis E. Meanwhile, the output gear 121 is supported in a freely rotatable manner with respect to the first rotator 6, and thus rotates clockwise by receiving the reaction force of the orbital motion of the planetary rotator 13. The output gear 121 amplifies and outputs the torque input to the input shaft 16, by rotating clockwise by an angle that corresponds to the difference in the number of teeth between the output gear 121 and the internal gear 14.

Specifically, assuming that the number of teeth of the planetary gear 131 is ZA, that the number of teeth of the output gear 121 is ZB, and that the number of teeth of the internal gear 14 is ZC, the output gear 121 rotates with reduced speed by a factor of (1−ZC/ZB) with respect to the rotation number of the input shaft 16. The output gear 121 then outputs a torque amplified by a factor of 1/(1−ZC/ZB) with respect to the torque input to the input shaft 16. That is, as the difference between the number of teeth ZB of the output gear 121 and the number of teeth ZC of the internal gear 14 is small, a larger output torque can be obtained even with the same input torque. Therefore, the motor 2 can be downsized. In FIG. 2 and FIG. 3, the number of teeth ZB of the output gear 121 and the number of teeth ZC of the internal gear 14 are the same; however, in practice, the number of teeth ZC of the internal gear 14 is smaller than the number of teeth ZB of the output gear 121 in order to cause the 2K-H type planetary gearmechanism to function as a speed reducer.

When the first rotator 6 and the second rotator 12 rotate relative to each other in a state where the output gear 121, the planetary gear 131, and the internal gear 14 mesh, a radial load is generated at each of the meshing portion between the output gear 121 and the planetary gear 131 and the meshing portion between the internal gear 14 and the planetary gear 131. When the radial load acts on the planetary rotator 13, the planetary rotator 13 and other components tilt with respect to the rotation axis O as in the invention according to Patent Literature 1 described above. Meanwhile, in the first embodiment, the following structure suppresses inclination of the planetary rotator 13 and other components due to a radial load.

Figure 4:
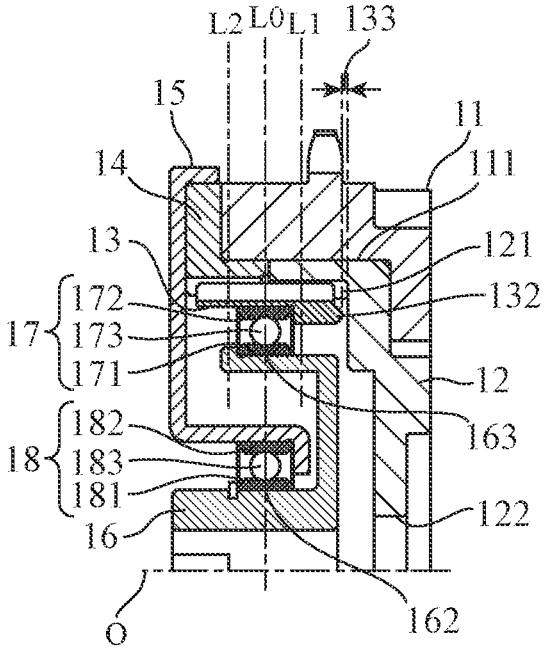
FIG. 4 is an enlarged view around a portion where gears mesh in the valve timing regulation device according to the first embodiment.

FIG. 4 is an enlarged view around a portion where gears mesh in the valve timing regulation device 1 according to the first embodiment. In FIG. 4, straight line L1 passes through the center position, in the direction of the rotation axis O, of the meshing portion where the output gear 121 meshes with the planetary gear 131. Straight line L2 passes through the center position, in the direction of the rotation axis O, of the meshing portion where the internal gear 14 meshes with the planetary gear 131. Straight line L0 passes through the middle position between straight line L1 and straight line L2, in the direction of the rotation axis O.

The planetary bearing 17 is disposed so that the center position of the planetary bearing 17 in the direction of the rotation axis O is present on straight line L0. Since the center position of the planetary bearing 17 is disposed on straight line L0, the moment of the radial load generated at the meshing portion between the output gear 121 and the planetary gear 131 is balanced with the moment of the radial load generated at the meshing portion between the internal gear 14 and the planetary gear 131 with the planetary bearing holder 163 serving as the fulcrum. As a result, the inclination of the planetary rotator 13 is suppressed.

The first bearing 18 is also disposed so that the center position of the first bearing 18 in the direction of the rotation axis O is present on straight line L0. The center position of the first bearing 18 is disposed on straight line L0. Since the center position of the first bearing 18 is disposed on straight line L0, the moment of the radial load generated at the meshing portion between the output gear 121 and the planetary gear 131 is balanced with the moment of the radial load generated at the meshing portion between the internal gear 14 and the planetary gear 131 with the first bearing holder 162 serving as the fulcrum. As a result, the inclination of the input shaft 16 is suppressed, and the inclination of the planetary rotator 13 that is generated due to the inclination of the input shaft 16 is also suppressed.

With the center position of the planetary bearing 17 and the center position of the first bearing 18 arranged on straight line L0, the planetary bearing 17 and the first bearing 18 are arranged on the same plane orthogonal to the rotation axis O. Note that the planetary bearing 17 and the first bearing 18 do not need to be arranged strictly on the same plane, and may include a shift caused by a tolerance or the like.

Furthermore, in FIG. 4, a protrusion 132 protruding toward the second rotator 12 may be formed on a surface of the planetary rotator 13 facing the second rotator 12. Note that since there is a gap 133 in the direction of the rotation axis O between the protrusion 132 and the second rotator 12, the protrusion 132 does not come into contact with the second rotator 12 when the planetary rotator 13 and the second rotator 12 rotate relatively. In case when the planetary rotator 13 is tilted with respect to the rotation axis O, the protrusion 132 abuts against the second rotator 12, thereby preventing the planetary rotator 13 from further tilting. Note that it is desirable that the protrusion 132 have a curved surface such as round chamfering in order to suppress wear and breakage of the protrusion 132 and the second rotator 12 due to the abutment of the protrusion 132 against the second rotator 12.

When the planetary rotator 13 is tilted with respect to the rotation axis O, the outer ring 172 of the planetary bearing 17 fixed to the planetary rotator 13 is also tilted, and thus a difference is generated between the inclination of the inner ring 171 and the inclination of the outer ring 172. If the inclination of the inner ring 171 or the outer ring 172 of the planetary bearing 17 exceeds an allowable inclination, the life of the planetary bearing 17 is shortened, thereby reducing the durability of the planetary bearing 17. The allowable inclination is a predetermined value that is dependent on, for example, the material forming the planetary bearing 17 and a gap inside the planetary bearing 17. Therefore, it is desirable to adjust the size of the gap 133 so that the inclination of the inner ring 171 or the outer ring 172 of the planetary bearing 17 does not exceed the allowable inclination even when the planetary rotator 13 is tilted with respect to the rotation axis O. With this structure, the protrusion 132 abuts against the second rotator 12 before the inclination of the inner ring 171 or the outer ring 172 of the planetary bearing 17 exceeds the allowable inclination when the planetary rotator 13 is tilted, thereby preventing further tilting of the inner ring 171 and the outer ring 172 of the planetary bearing 17.

Note that in a case where the protrusion 132 is not formed in the planetary rotator 13, it is desirable that the gap between the planetary rotator 13 and the second rotator 12 in the direction of the rotation axis O be adjusted so that the inclination of the inner ring 171 or the outer ring 172 of the planetary bearing 17 does not exceed the allowable inclination even when the planetary rotator 13 is tilted.

Next, the operation of the valve timing regulation device 1 mounted on an engine will be described.

Figure 5:
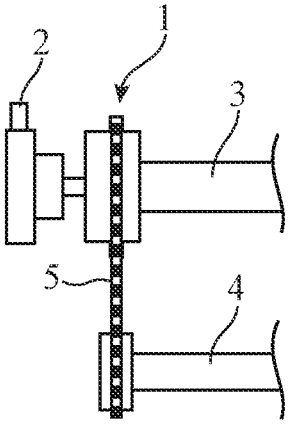
FIG. 5 is a schematic diagram of an engine mounted with the valve timing regulation device according to the first embodiment.

FIG. 5 is a schematic diagram of an engine mounted with the valve timing regulation device 1 according to the first embodiment. As illustrated in FIG. 1, a center bolt 20 is inserted into an insertion hole 122 formed in the second rotator 12, and the second rotator 12 is thereby fastened to the camshaft 3. In addition, as illustrated in FIG. 5, an annular chain 5 is wound on the sprockets 112 formed on the outer circumferential surface of the case 11 and wound around the outer circumferential surface of the crankshaft 4.

The rotational movement of the crankshaft 4 is transmitted to the first rotator 6 of the valve timing regulation device 1 via the chain 5, and causes the first rotator 6 to rotate. The second rotator 12 rotates while maintaining a relative rotational position with respect to the first rotator 6. The camshaft 3 rotates integrally with the second rotator 12.

The motor 2 is controlled by a control device (not illustrated) to rotate, thereby causing the input shaft 16 meshing with the output shaft of the motor 2 to rotate. The relative rotational position between the first rotator 6 and the second rotator 12 is regulated depending on the rotation of the input shaft 16 by the motor 2.

The motor 2 causes the input shaft 16 to rotate with the rotation number greater than the rotation number of the first rotator 6, when the valve timing regulation device 1 is caused to perform advance operation. At this point, the second rotator 12 rotates in the advance direction relative to the first rotator 6, by the operation principle of the 2K-H type planetary gear mechanism.

The motor 2 causes the input shaft 16 to rotate with the rotation number smaller than the rotation number of the first rotator 6 or in a reverse direction to the rotation direction of the first rotator 6, when the valve timing regulation device 1 is caused to perform retard operation. At this point, the second rotator 12 rotates in the retard direction relative to the first rotator 6, by the operation principle of the 2K-H type planetary gear mechanism.

Note that the relative rotational position between the second rotator 12 and the first rotator 6 is maintained, when the motor 2 causes the input shaft 16 to rotate at the same rotation number as that of the first rotator 6.

Figure 6:
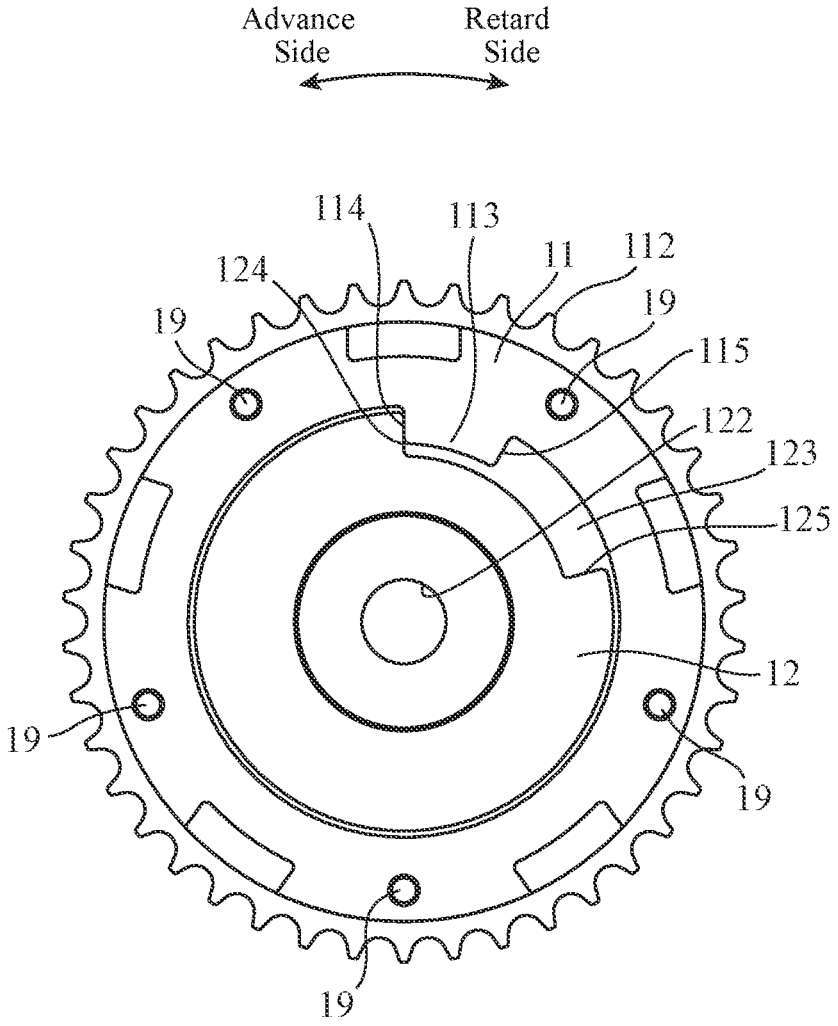
FIG. 6 is an arrow view of the valve timing regulation device according to the first embodiment as viewed from the direction of arrow III in FIG. 1.

FIG. 6 is an arrow view of the valve timing regulation device 1 according to the first embodiment as viewed from the direction of arrow III in FIG. 1. When the valve timing regulation device 1 is viewed from the direction of arrow III in FIG. 1, that is, from the camshaft 3 side, the clockwise direction is the retard direction and the counterclockwise direction is the advance direction. In the example of FIG. 6, the relative rotational position between the first rotator 6 and the second rotator 12 is regulated to the most retarded angle position.

On the surface of the case 11 facing the camshaft 3, a stopper protrusion 113 having a shape protruding inward in the radial direction is formed. One end of the stopper protrusion 113 in the circumferential direction is a retard side stopper 114, and the other end is an advance side stopper 115. On the surface of the second rotator 12 facing the camshaft 3, a stopper recess 123 having a shape recessed inward in the radial direction is formed. One end of the stopper recess 123 in the circumferential direction is a retard side stopper 124, and the other end is an advance side stopper 125.

During advance operation and retard operation of the valve timing regulation device 1, the stopper protrusion 113 moves inside the stopper recess 123 in the circumferential direction. The retard side stopper 114 of the stopper protrusion 113 and the retard side stopper 124 of the stopper recess 123 abut with each other, so that the relative rotational position between the first rotator 6 and the second rotator 12 is regulated at the most retarded angle position. Meanwhile, the advance side stopper 115 of the stopper protrusion 113 and the advance side stopper 125 of the stopper recess 123 abut with each other, so that the relative rotational position between the first rotator 6 and the second rotator 12 is regulated at the most advanced angle position.

As described above, according to the first embodiment, the first rotator 6 includes the internal gear 14 and rotates in conjunction with the crankshaft 4. The second rotator 12 includes the output gear 121, and rotates in conjunction with the camshaft 3. The planetary rotator 13 includes the planetary gear 131 that meshes with the internal gear 14 and the output gear 121, and the planetary gear 131 meshes with the internal gear 14 and the output gear 121 to perform planetary motion, thereby changing the relative rotational position between the first rotator 6 and the second rotator 12. The input shaft 16 causes the planetary rotator 13 to perform planetary motion. The first bearing 18 is interposed between the input shaft 16 and the first rotator 6. The planetary bearing 17 is interposed between the input shaft 16 and the planetary rotator 13, and is included on the same plane orthogonal to the rotation axis O as the first bearing 18. Since the first bearing 18 and the planetary bearing 17 are arranged on the same plane, the inclination of the input shaft 16 with respect to the rotation axis O is suppressed, and the inclination of the planetary rotator 13 generated due to the inclination of the input shaft 16 with respect to the rotation axis O is also suppressed. Moreover, in the first embodiment, since the inclination of the input shaft 16 and the planetary rotator 13 is suppressed, generation of a thrust load at the meshing portion where each of the internal gear 14 and the output gear 121 meshes with the planetary gear 131 is prevented, thereby preventing a reduction in durability and output of the valve timing regulation device 1.

In the invention according to Patent Literature 1, the two bearings are arranged side by side in the direction of the rotation axis O. Contrarily, in the first embodiment, the first bearing 18 and the planetary bearing 17 are arranged on the same plane orthogonal to the rotation axis O, and thus the valve timing regulation device 1 thin in the direction of the rotation axis O can be implemented. Furthermore, in the invention according to Patent Literature 1, in order to suppress the inclination of the planetary rotator and other components, it is necessary to support the planetary rotator and other components by using a double-row rolling bearing thick in the direction of the rotation axis O. Meanwhile, in the first embodiment, since the inclination of the planetary rotator 13 and the input shaft 16 is suppressed, a single-row rolling bearing thin in the direction of the rotation axis O can be used as each of the first bearing 18 and the planetary bearing 17, and thus the thickness of the valve timing regulation device 1 can be further reduced.

Furthermore, the first bearing 18 and the planetary bearing 17 of the first embodiment are arranged on a line (i.e. straight line L0) so that the distance from the line to the center position (i.e. straight line L2) in the direction of the rotation axis O of the meshing portion where the internal gear 14 and the planetary gear 131 mesh, is equal to the distance from the line to the center position (i.e. straight line L1) in the direction of the rotation axis O of the meshing portion where the output gear 121 and the planetary gear 131 mesh. With this structure, the moment at the meshing portion between the internal gear 14 and the planetary gear 131 is balanced with the moment at the meshing portion between the output gear 121 and the planetary gear 131, and thus the inclination of the planetary rotator 13 and the input shaft 16 with respect to the rotation axis O is regulated.

The planetary rotator 13 of the first embodiment has the protrusion 132 on the surface facing the second rotator 12. The protrusion 132 abuts against the second rotator 12, so that excessive inclination of the planetary rotator 13 is prevented.

Note that the protrusion 132 may be formed also on the surface of the planetary rotator 13 facing the first rotator 6, that is, the surface of the planetary rotator 13 facing the cover 15.

It is desirable that the protrusion 132 of the first embodiment have a curved surface. The protrusion 132 has a curved surface, so that wear and breakage of the planetary rotator 13 and the second rotator 12 are suppressed.

Furthermore, in a case where the planetary bearing 17 of the first embodiment is a rolling bearing including the inner ring 171, the outer ring 172, and the rolling elements 173, a gap between the planetary rotator 13 and the second rotator 12 in the direction of the rotation axis O has a size that does not the inclination of the inner ring 171 or the outer ring 172 of the planetary bearing 17 to exceed the allowable inclination when the planetary rotator 13 is tilted with respect to the rotation axis O. Note that in a case where the protrusion 132 is formed in the planetary rotator 13, the gap 133 between the protrusion 132 and the second rotator 12 in the direction of the rotation axis O has a size that does not allow the inclination of the inner ring 171 or the outer ring 172 of the planetary bearing 17 to exceed the allowable inclination when the planetary rotator 13 is tilted with respect to the rotation axis O. With this configuration, a decrease in durability of the planetary bearing 17 is prevented.

Second Embodiment

Figure 7:
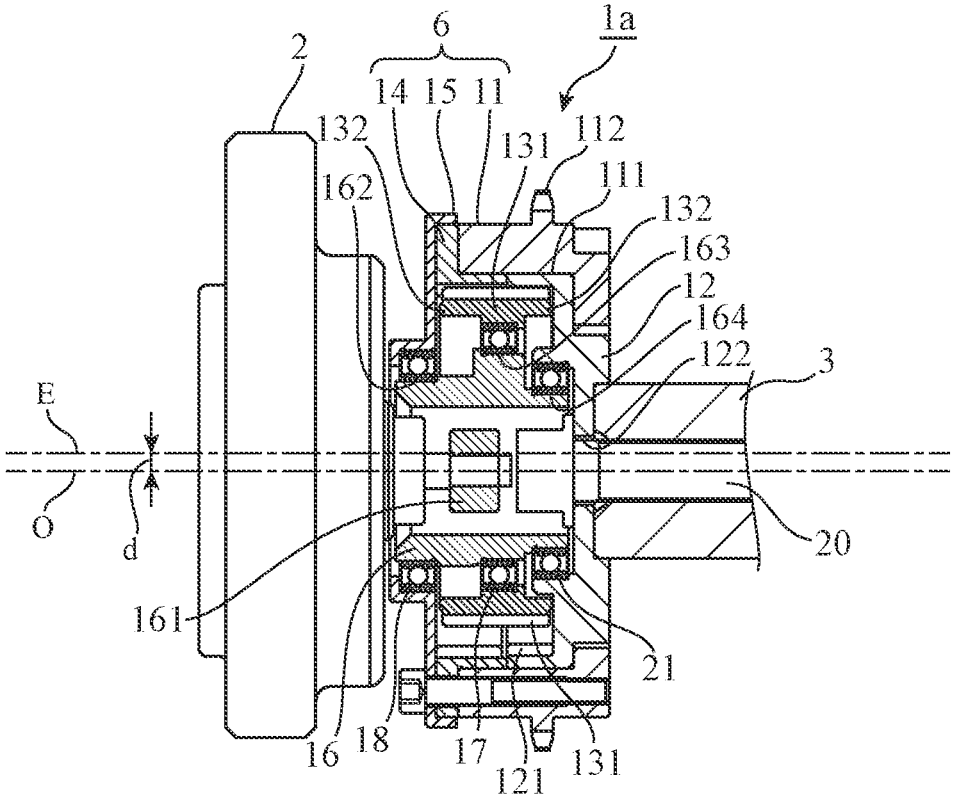
FIG. 7 is a cross-sectional view illustrating a configuration example of a valve timing regulation device according to the second embodiment.

FIG. 7 is a cross-sectional view illustrating a configuration example of a valve timing regulation device 1*a* according to a second embodiment. In FIG. 7, the same or corresponding parts as those in FIG. 1 to FIG. 6 are denoted by the same symbols and description thereof is omitted. The valve timing regulation device 1*a* according to the second embodiment has a structure to which a second bearing 21 is added, and an input shaft 16 is supported by two bearings of a first bearing 18 and the second bearing 21.

Like in the first embodiment, the input shaft 16 of the second embodiment includes a first bearing holder 162 that holds the first bearing 18 at a position centered at the rotation axis O, and a planetary bearing holder 163 for holding a planetary bearing 17 at a position centered at an eccentric axis E that is eccentric in the radial direction by an eccentric distance d with respect to the rotation axis O. The input shaft 16 of the second embodiment further includes a second bearing holder 164 that holds the second bearing 21 at a position centered at the rotation axis O.

The second bearing 21 is interposed between the second bearing holder 164 and a second rotator 12, and causes the input shaft 16 and the second rotator 12 to rotate relatively. The second bearing 21 is, for example, a single-row rolling bearing having an inner ring, an outer ring, and a plurality of rolling elements. The first bearing 18 is disposed at the end of the input shaft 16 on a motor 2 side, and the second bearing 21 is disposed at the end of the input shaft 16 on a camshaft 3 side, and thus the input shaft 16 is supported at both ends thereof by the first bearing 18 and the second bearing 21.

As described above, according to the second embodiment, a first rotator 6 includes an internal gear 14 and rotates in conjunction with a crankshaft 4. The second rotator 12 includes the output gear 121, and rotates in conjunction with the camshaft 3. The planetary rotator 13 includes the planetary gear 131 that meshes with the internal gear 14 and the output gear 121, and the planetary gear 131 meshes with the internal gear 14 and the output gear 121 to perform planetary motion, thereby changing the relative rotational position between the first rotator 6 and the second rotator 12. The input shaft 16 causes the planetary rotator 13 to perform planetary motion. The first bearing 18 is interposed between the input shaft 16 and the first rotator 6. The planetary bearing 17 is interposed between the input shaft 16 and the planetary rotator 13. The second bearing 21 is interposed between the input shaft 16 and the second rotator 12. Since the input shaft 16 is supported by the first bearing 18 and the second bearing 21, the inclination with respect to the rotation axis O is suppressed. In addition, the inclination of the planetary rotator 13 that occurs due to the inclination of the input shaft 16 with respect to the rotation axis O is also suppressed. Therefore, generation of a thrust load at the meshing portion where each of the internal gear 14 and the output gear 121 meshes with the planetary gear 131 is prevented, thereby preventing a reduction in durability and output of the valve timing regulation device 1.

Note that it is desirable that, like in the first embodiment, the planetary bearing 17 of the second embodiment be disposed on a line (i.e. straight line L0 in FIG. 4) so that the distance from the line to the center position (i.e. straight line L2 in FIG. 4) in the direction of the rotation axis O of the meshing portion where the internal gear 14 and the planetary gear 131 mesh, is equal to the distance from the line to the center position (i.e. straight line L1 in FIG. 4) in the direction of the rotation axis O of the meshing portion where the output gear 121 and the planetary gear 131 mesh.

It is also desirable that, like in the first embodiment, the planetary rotator 13 of the second embodiment be formed with a protrusion 132 on the surface facing the second rotator 12 and a protrusion 132 on the surface facing a cover 15 of the first rotator 6. The protrusion 132 may be formed on one of the surface of the planetary rotator 13 facing the second rotator 12 and the surface thereof facing the cover 15. Furthermore, it is desirable that the protrusion 132 have a curved surface such as round chamfering.

Note that the present invention may include a flexible combination of the embodiments, a modification of any component of the embodiments, or omission of any component in the embodiments, within the scope of the present invention.

INDUSTRIAL APPLICABILITY

Since a valve timing regulation device according to the present invention prevents a decrease in durability or output by suppressing the inclination of a planetary rotator, the valve timing regulation device is suitable for regulating the opening and closing timing of an intake valve or an exhaust valve of an engine.

REFERENCE SIGNS LIST

1, 1*a*: valve timing regulation device, 2: motor, 3: camshaft, 4: crankshaft, 5: chain, 6: first rotator, 11: case, 111: slide bearing, 112: sprocket, 113: stopper protrusion, 114: retard side stopper, 115: advance side stopper, 12: second rotator, 121: output gear (second gear portion), 122: insertion hole, 123: stopper recess, 124: retard side stopper, 125: advance side stopper, 13: planetary rotator, 131: planetary gear (planetary gear portion), 132: protrusion, 133: gap, 14: internal gear (first gear portion), 15: cover, 16: input shaft, 161: fitting portion, 162: first bearing holder, 163: planetary bearing holder, 164: second bearing holder, 17: planetary bearing, 171, 181: inner ring, 172, 182: outer ring, 173, 183: rolling element, 18: first bearing, 19: bolt, 20: center bolt, 21: second bearing, d: eccentric distance, E: eccentric axis, L0, L1, L2: straight line, O: rotation axis

The invention claimed is:

1. A valve timing regulation device comprising:

a first rotator configured to rotate in conjunction with a crankshaft, the first rotator including a first gear portion;

a second rotator configured to rotate in conjunction with a camshaft, the second rotator including a second gear portion;

a planetary rotator including a planetary gear portion that meshes with the first gear portion and the second gear portion so as to change a relative rotational position between the first rotator and the second rotator;

an input shaft configured to drive the planetary rotator;

a first bearing interposed between the input shaft and the first rotator; and a planetary bearing interposed between the input shaft and the planetary rotator so as to radially surround the first bearing.

2. The valve timing regulation device according to claim 1, wherein the first bearing and the planetary bearing are aligned with a center position of the planetary gear portion along an axial direction of the input shaft.

3. The valve timing regulation device according to claim 1, wherein the planetary rotator includes a protrusion on at least one of a surface facing the first rotator or a surface facing the second rotator.

4. The valve timing regulation device according to claim 3, wherein the protrusion has a curved surface.

5. The valve timing regulation device according to claim 1, wherein the planetary bearing is a rolling bearing including an inner ring, an outer ring, and rollers, and wherein a gap between the planetary rotator and the second rotator in an axial direction of the input shaft is dimensioned so as to prevent an inclination of the inner ring or the outer ring from exceeding an allowable inclination when the planetary rotator is tilted with respect to the axial direction.

6. A valve timing regulation device comprising:

a first rotator configured to rotate in conjunction with a crankshaft, the first rotator including a first gear portion;

a second rotator configured to rotate in conjunction with a camshaft, the second rotator including a second gear portion;

a planetary rotator including a planetary gear portion that meshes with the first gear portion and the second gear portion so as to change a relative rotational position between the first rotator and the second rotator;

an input shaft configured to drive the planetary rotator;

a first bearing interposed between the input shaft and the first rotator;

a second bearing interposed between the input shaft and the second rotator; and a planetary bearing interposed between the input shaft and the planetary rotator.

7. The valve timing regulation device according to claim 6, wherein the planetary rotator is formed with a protrusion on at least one of a surface facing the first rotator or a surface facing the second rotator.

8. The valve timing regulation device according to claim 7, wherein the protrusion has a curved surface.

* * * * *